US012507844B1

(12) United States Patent
Seigler

(10) Patent No.: US 12,507,844 B1
(45) Date of Patent: Dec. 30, 2025

(54) MAGNETIC COUPLING SYSTEM FOR A REMOVABLE TOILET SEAT LID

(71) Applicant: David M. Seigler, Raleigh, NC (US)

(72) Inventor: David M. Seigler, Raleigh, NC (US)

( * ) Notice: Subject to any disclaimer, the term of this patent is extended or adjusted under 35 U.S.C. 154(b) by 0 days.

(21) Appl. No.: 19/348,493

(22) Filed: Oct. 2, 2025

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/12; A47K 13/26
See application file for complete search history.

(56) References Cited

U.S. PATENT DOCUMENTS 3,038,173 A 6/1962 Turek et al.
3,550,164 A 12/1970 Pease
4,342,124 A 8/1982 Paredes
4,384,375 A 5/1983 Gerome
4,561,130 A 12/1985 Bumgardner
7,089,627 B2 8/2006 Seidler
8,185,974 B2 5/2012 Mauduit
2024/0374090 A1 11/2024 Ren et al.
2025/0009194 A1 1/2025 Wu

*Primary Examiner* — Christine J Skubinna
(74) *Attorney, Agent, or Firm* — Ashley D. Johnson; Dogwood Patent and Trademark Law

(57) ABSTRACT

The invention is a magnetic coupling system for use with a removable toilet seat lid. The system includes a hinge arm configured for attachment to a toilet bowl. The hinge arm incorporates a coated magnet that extends from a base surface. The toilet lid is formed with a recessed insert configured to receive the coated magnet via magnetic attraction. When the lid is installed, a secure, stable connection is achieved that holds the lid in place during normal use. The connection is releasable by lifting the lid from a closed position, allowing the lid to be easily removed and replaced. The system enables customizable, interchangeable toilet lids to be installed while maintaining structural integrity and reliable attachment.

20 Claims, 12 Drawing Sheets

MAGNETIC COUPLING SYSTEM FOR A REMOVABLE TOILET SEAT LID

FIELD OF THE INVENTION

The presently disclosed subject matter relates to a magnetic coupling system for a removable toilet seat lid. The method also includes methods of making and using the disclosed magnetic coupling system.

BACKGROUND OF THE INVENTION

Conventional toilet seat assemblies include a pair of hinge arms that secure a seat and lid to the toilet bowl using mechanical fasteners such as bolts, screws, or clips. The conventional systems therefore create a fixed, permanent connection that is not designed for frequent removal. As a result, changing a toilet lid for cleaning, maintenance, and/or decorative purposes generally requires tools, disassembly of the hinge hardware, and reinstallation that are time-consuming and inconvenient for users. In addition, permanent hardware can corrode, seize, or become difficult to remove over time, making replacement of the toilet lid impractical or costly. As a result, attempts to detach the lid can damage the ceramic surface of the toilet bowl and/or compromise the integrity of the hinge components. Furthermore, once installed, permanent assemblies offer little to no flexibility for customization, preventing users from easily updating the appearance of the toilet to match seasonal décor, branding, or personal preference.

In response, detachable toilet seats have been developed that allow the seat and lid to be removed more easily. However, many of the detachable systems rely on latch-based mechanisms that incorporate moving parts that often become clogged with debris or fail over time. Snap-fit or friction-based interfaces can further loosen with repeated use, leading to instability, rattling, or accidental detachment during normal operation. In addition, removable systems that use complex release buttons or locking tabs often require two-handed operation and significant force to engage or disengage the toilet lid/seat, providing challenges for users with reduced strength or dexterity. Additionally, some removable seat systems leave exposed gaps or hardware once detached, which can collect dirt and bacteria. Other prior systems require precise alignment for reinstallation, making reattachment cumbersome and frustrating.

It would therefore be beneficial to provide an improved attachment system for toilet lids that maintains a secure, reliable connection during normal operation while allowing tool-free, user-friendly removal and replacement.

SUMMARY OF THE INVENTION

The presently disclosed subject matter is directed to a magnetic coupling system for a toilet seat assembly that enables secure attachment of a toilet lid while allowing tool-free removal and replacement. The system includes a seat arm incorporating a coated magnet that cooperates with a toilet lid defined by a recessed insert dimensioned to receive the coated magnet. Magnetic attraction between the components forms a stable, releasable connection that maintains structural integrity during normal use yet permits the lid to be easily detached by lifting from a closed position.

In some embodiments, the presently disclosed subject matter is directed to a hinge assembly for a toilet seat and lid. As used herein, the term "toilet seat" refers to the generally ring-shaped or contoured component mounted on the upper rim of a toilet bowl that provides a seating surface for a user and is configured to pivot upward and downward about a hinge axis. The toilet lid is the cover positioned above the toilet seat that is configured to pivot about a hinge axis between a closed position that overlies the seat and bowl, and an open position in which it is raised away from the toilet bowl and seat.

The assembly comprises a hinge pin comprising a first end, a second end, and a body extending therebetween. The assembly also includes a mounting bracket configured to be secured to an upper rear deck portion of a toilet bowl. The mounting bracket comprises a bracket body defined by at least one aperture configured to position and support the mounting bracket relative to the toilet bowl, and a bracket bore positioned at one end of the bracket body and configured to receive the hinge pin. The assembly also includes a seat arm comprising a seat arm bore configured to receive the hinge pin and allow rotation of the seat arm about the hinge pin. The seat arm also includes a seat arm body comprising one or more apertures configured to receive mechanical fasteners to secure the seat arm to a toilet seat, and a seat arm neck extending between the seat arm bore and the seat arm body to structurally connect the seat arm bore and the seat arm body. The assembly includes a lid arm that includes a lid arm bore configured to receive the hinge pin and allow rotation of the lid arm about the hinge pin, and a lid arm body extending from the lid arm bore and comprising a magnet projecting above an upper surface of the lid arm body and configured to magnetically engage a receiver disposed in a toilet lid. The lid arm also includes a lid arm neck extending between the lid arm bore and the lid arm body to structurally connect the lid arm bore and the lid arm body. The hinge pin, seat arm, and lid arm cooperate to allow the toilet seat and lid to pivot (e.g., independently pivot) upward and downward about a rotational axis. The magnet and the receiver are configured such that the lid is removably attachable to the lid arm by magnetic attraction between the magnet and the receiver without the use of tools.

In some embodiments, the magnet is a neodymium magnet.

In some embodiments, the receiver comprises a coated ferromagnetic insert positioned within a groove (e.g., cavity, recess, depression, or hollowed-out region) on an underside of the toilet lid. The underside of the toilet lid refers to the surface of the lid that faces downward toward the toilet bowl and seat when the lid is installed in its closed position. A "coated ferromagnetic insert" refers to a component formed from a magnetically responsive material (such as iron, low-carbon steel, stainless steel, nickel, cobalt, and/or a ferromagnetic alloy) configured to be attracted to a permanent magnet and thereby facilitate magnetic attachment. The insert is sized and shaped to fit within a groove formed on the underside of the toilet lid and is secured therein by molding, adhesive bonding, mechanical retention, or a combination thereof. The insert can include a coating (e.g., a continuous layer of protective material applied to at least its exposed surface) to enhance corrosion resistance, prevent oxidation, and reduce wear during repeated engagement and disengagement with the magnet. Suitable coatings include metallic layers such as nickel or zinc plating, polymeric layers such as parylene or polyurethane, or epoxy-based coatings that form a non-porous barrier against moisture and cleaning agents commonly present in bathroom environments. The coated ferromagnetic insert serves as the magnetic counterpart to the magnet disposed in the lid arm.

In some embodiments, the magnet includes a beveled edge configured to form a sealed fit with the receiver. A "sealed fit" refers to a close, complementary engagement between two components (e.g., the beveled edge of the magnet and the surface of the receiver) that minimizes or substantially prevents the passage of moisture, liquids, or debris into the interface region between them when the toilet lid is attached. The sealed fit is achieved by shaping the beveled edge and the corresponding receiver surface so that they contact or closely conform to one another, thereby forming a barrier that protects the magnetic connection and improves durability, alignment, and long-term performance.

In some embodiments, the beveled edge has an angle of about 3 degrees to about 5 degrees (e.g., at least/no more than about 1, 2, 3, 4, 5, 6, 7, 8, 9, or 10 degrees). As used herein, the phrase "beveled edge has an angle of about 3 degrees to about 5 degrees" refers to the angle formed between the beveled surface and a reference line or plane that is substantially perpendicular to the upper surface of the lid arm body. In other words, if the magnet includes a generally vertical peripheral sidewall extending upward from the lid arm body, the beveled edge is sloped inward or outward relative to the vertical sidewall by about 3-5 degrees. The angular configuration produces a slight taper at the perimeter of the magnet that facilitates guided insertion of the magnet into the corresponding receiver cavity, enhances the sealing engagement between the components, and improves overall retention while still allowing tool-free removal of the lid.

In some embodiments, the magnet extends above an upper surface of the lid arm to project into the receiver when the lid is installed. Thus, the magnet extends above an upper surface of the lid arm so that a portion of the magnet projects into the receiver cavity when the toilet lid is installed. The projecting configuration ensures that the magnet physically enters and aligns within the receiver rather than merely contacting its lower surface, thereby increasing the effective magnetic coupling strength and improving positional stability of the lid during use. The extended projection also helps maintain a consistent magnetic field alignment, reducing the likelihood of accidental disengagement while still permitting tool-free removal of the lid when an upward force is applied.

In some embodiments, the mounting bracket defines a bore through which the hinge pin extends and an aperture for a mechanical fastener that secures the mounting bracket to the toilet bowl. The aperture can be a hole, slot, or opening specifically sized and positioned to receive a mechanical fastener (e.g., screw, bolt, or anchor) that secures the mounting bracket to the upper rear deck portion of the toilet bowl. The aperture functions as a guide and retention feature for the fastener, ensuring that the fastener passes through the bracket and into a corresponding hole or threaded region in the toilet bowl to fix the bracket in place. Once installed, the fastener cooperates with the aperture to maintain position and alignment, providing structural support for the hinge pin and the pivoting motion of the seat and lid assembly.

In some embodiments, the receiver and the magnet are shaped to self-center during engagement, thereby ensuring proper alignment of the toilet lid without manual positioning. As used herein, the term "self-centering" refers to the ability of two components (e.g., the magnet and the receiver) to automatically move into proper alignment with one another during engagement, without requiring precise manual positioning by the user. In some embodiments, the magnet and receiver are shaped or contoured such that, as the toilet lid is lowered toward the lid arm, the geometry of the magnetic interface (e.g., a beveled edge surrounding the magnet and a complementary recess around the receiver as shown in FIG. 6*b*) acts to guide the components into a centered position relative to each other. The self-centering action ensures that the magnet is properly seated within the receiver even if the lid is initially misaligned, thereby improving ease of installation, reducing the likelihood of partial or incomplete engagement, and enhancing the overall strength and reliability of the magnetic connection. The feature also allows users to replace or reattach the toilet lid quickly and accurately without tools or visual alignment, further supporting tool-free installation and removal.

In some embodiments, the magnet and receiver are configured to permit tool free removal and replacement of the toilet lid. As used herein, "tool free" refers to a configuration that allows a user to remove and replace the toilet lid without the need for external tools, instruments, and/or mechanical devices such as screwdrivers, wrenches, or pry bars. Thus, the magnetic engagement between the hinge arm magnet and the receiver is designed to be overcome by manual force alone (e.g., by lifting the lid upward with one or both hands of a user) without disassembling any components of the hinge assembly or loosening any fasteners. Likewise, tool free replacement includes that the toilet lid can be reinstalled by manually positioning it so that the receiver aligns with and magnetically engages the hinge arm magnet, without the need for specialized alignment equipment or mechanical assistance. The configuration enables quick, convenient removal for cleaning, maintenance, or replacement and subsequent reattachment by an average user without technical expertise.

In some embodiments, the magnet is coated with a non-porous corrosion-resistant layer selected from nickel, epoxy, or polymeric coatings. Examples of suitable nickel coatings include electroless nickel-phosphorus coatings that deposit a uniform nickel alloy layer without the use of electrical current and offer hardness and corrosion resistance; electroplated nickel coatings that form a durable protective surface that resists wear and oxidation; and multilayer Ni—Cu—Ni coatings that incorporate a copper interlayer to enhance adhesion and an outer nickel layer to maximize environmental protection.

Examples of epoxy coatings include two-part epoxy resin films that cure into a dense, non-porous barrier ideal for humid environments; powder epoxy coatings applied electrostatically and cured to form a robust shell around the magnet; and high-durability epoxy paint coatings that resist water, cleaning agents, and mild chemicals commonly encountered in bathrooms. Thus, suitable epoxy coatings can include bisphenol-A, bispohenol0F, novolac, diglycidyl ether of bisphenol-A (DGEBA), and cycloaliphatic families. Examples of polymeric coatings include parylene coatings, such as parylene C or N that are applied via vapor deposition to form ultra-thin, pinhole-free barriers; PTFE (polytetrafluoroethylene) coatings that provide non-stick and hydrophobic surfaces that minimize moisture contact and debris accumulation; and polyurethane coatings that offer flexibility along with strong resistance to water and chemical exposure. The coatings help ensure long-term performance of the magnetic interface by preventing corrosion, maintaining magnetic strength, and extending the service life of the hinge assembly in wet or humid environments.

As used herein, the term "non-porous" refers to a material and/or coating that is substantially free of pores, voids, or openings that would allow the passage or absorption of liquids, gases, or fine particles under normal operating conditions. In the context of the present disclosure, a non-porous coating is one that forms a continuous barrier layer over the surface of the magnet, thereby preventing moisture, water vapor, and/or contaminants from penetrating into the magnet material. The coatings are typically applied as a uniform film and maintain structural integrity over repeated cycles of use and cleaning.

"Corrosion-resistant" refers to a material or surface treatment that is capable of resisting chemical or electrochemical degradation (e.g., rusting, oxidation, or pitting) when exposed to moisture, cleaning agents, and other environmental conditions commonly present in a bathroom environment. A corrosion-resistant coating functions to protect the underlying magnet material from deterioration, thereby preserving magnetic strength, mechanical integrity, and service life over extended use.

In some embodiments, the lid arm body comprises a beveled guide surface surrounding the magnet and configured to guide the receiver into alignment during lid installation. Thus, beveled guide surface can be angled inwardly toward the magnet to form a tapered lead-in region. The configuration helps direct and center the receiver as the toilet lid is lowered into place, even if the lid is slightly misaligned during installation. By funneling the receiver toward the magnet, the beveled guide surface reduces the need for precise manual alignment, ensures consistent engagement between the magnet and receiver, and promotes a secure magnetic connection with minimal user effort.

In some embodiments, the magnet and the receiver are configured to generate a magnetic holding force of between about 5-20 newtons (N) (at least/no more than about 1, 5, 10, 15, 20, 25, or 30 N) when the lid is attached. As used herein, the magnetic holding force refers to the peak separation force required to disengage the magnet from the receiver under controlled conditions. The magnetic holding force can be determined using a standard pull-force test in which the magnet is brought into direct contact with a flat ferromagnetic target surface of known composition, surface finish, and thickness. A calibrated force gauge or tensile testing apparatus can then be used to apply a perpendicular separation force until the magnet and receiver disengage, with the maximum recorded force representing the magnetic holding force. The measurement approach is consistent with industry-accepted practices for evaluating magnetic coupling strength and can be performed in accordance with general principles described in ASTM A977 (incorporated by reference herein) or analogous magnetic property testing procedures.

In some embodiments, the receiver comprises a magnetically responsive disc formed from a ferromagnetic alloy selected from iron, low-carbon steel, or nickel-iron alloy. A "magnetically responsive disc" refers to a generally flat, disc-shaped component formed from a ferromagnetic or magnetically permeable material configured to be attracted to a permanent magnet and thereby facilitate magnetic coupling. As used herein, the term "ferromagnetic alloy" refers to a metallic material that includes two or more elements, at least one of which is ferromagnetic, that exhibits strong magnetic permeability and is capable of being magnetized or attracted to a magnetic field. The alloys are specifically engineered or selected for their ability to concentrate magnetic flux and form a robust magnetic coupling when positioned adjacent to a permanent magnet.

Examples of ferromagnetic alloys include iron-based alloys such as low-carbon steel and silicon steel that combine high magnetic responsiveness with good mechanical strength; nickel-iron alloys (e.g., Permalloy, containing approximately 80% nickel and 20% iron) that provide high magnetic permeability and low coercivity; and cobalt-iron alloys (e.g., Hiperco®, containing approximately 49% cobalt and 49% iron) known for their exceptional saturation magnetization. Other examples include ferritic stainless steels that retain significant ferromagnetic properties while offering improved corrosion resistance, and various soft magnetic composites engineered for optimized flux conduction in compact or specialized magnetic interfaces.

In some embodiments, the presently disclosed subject matter is directed to a method of installing the disclosed hinge assembly on a toilet bowl. The method comprises securing a mounting bracket of the disclosed hinge assembly to a rear portion of the toilet bowl, inserting the hinge pin through the bore in the mounting bracket, coupling the seat arm to the hinge pin and fastening the seat arm to a toilet seat. The method also includes coupling the lid arm to the hinge pin and magnetically attaching the toilet lid to the lid arm. It should be appreciated that the method steps can be performed in any order.

In some embodiments, magnetically attaching the toilet lid comprises aligning the receiver cavity on an underside of the toilet lid with the magnet disposed in the lid arm.

In some embodiments, securing the mounting bracket comprises inserting one or more mechanical fasteners through the one or more apertures in the mounting bracket and into preformed holes in the toilet bowl. "Mechanical fasteners" include any hardware element configured to mechanically join, secure, and/or anchor one component to another via insertion, engagement, or clamping. Suitable mechanical fasteners include (but are not limited to) screws, such as machine screws, self-tapping screws, wood screws, and sheet metal screws; bolts and nuts, including hex bolts, carriage bolts, lag bolts, and wing nuts; rivets, such as blind rivets and solid rivets; pins, including dowel pins, spring pins, and taper pins; anchors, such as expansion anchors, plastic wall anchors, and threaded inserts; studs; nails; clips; clamps; retaining rings; brackets; hooks; and snap-fit connectors. In some embodiments, the mechanical fasteners can be made from metal, polymeric, or composite materials and can include surface treatments such as coatings or plating to enhance corrosion resistance and durability.

In some embodiments, the hinge pin provides a rotational axis about which both the toilet seat and toilet lid pivot (e.g., independently pivot such that that the toilet seat can be up or down independent of whether the lid is up or down and vice versa). The rotational axis refers to an imaginary straight line around which a component is configured to rotate or pivot. In the context of the disclosed hinge assembly, the rotational axis is defined by the longitudinal centerline of the hinge pin extending through the mounting brackets, seat arm, and lid arm. Thus, the hinge pin establishes a fixed rotational axis about which both the toilet seat and the toilet lid are configured to pivot. The seat arm (secured to the toilet seat) and the lid arm (which engages with the toilet lid) are each mounted for rotation about the common axis, enabling the seat and lid to independently swing upward and downward between open and closed positions relative to the toilet bowl. The shared rotational axis ensures coordinated movement of the seat and lid, maintains proper alignment during operation, and allows for smooth, repeatable motion with minimal friction or misalignment over repeated use.

In some embodiments, the method includes removing the toilet lid by applying an upward force sufficient to overcome magnetic attraction between the magnet and the receiver. Thus, a user can lift the lid vertically using one or both hands to separate the magnet and receiver without the need for tools, mechanical release mechanisms, or disassembly of the hinge assembly. The upward force required is strong enough to maintain a secure magnetic connection during normal use, such as opening and closing the lid, yet low enough to permit intentional removal of the lid by an average user without excessive effort.

In some embodiments, the method includes replacing the toilet lid with a second toilet lid having a receiver configured to engage the magnet.

In some embodiments, attaching the lid arm comprises inserting the hinge pin into the bore formed in the lid arm and positioning the recessed region of the lid arm adjacent to a seat buffer.

In some embodiments, the magnetic attachment permits tool-free removal and reinstallation of the toilet lid by a user.

In some embodiments, the presently disclosed subject matter is directed to a method of using the disclosed toilet hinge assembly. The method includes selectively detaching a toilet lid from the hinge assembly, where the mounting bracket is secured to the rear deck of the toilet bowl, the seat arm is secured to the toilet seat, the hinge pin extends through the bracket bore, the seat arm bore, and the lid arm bore, and the lid arm magnet is engaged with the groove of the toilet lid, where the selective detachment is achieved by lifting the lid to disengage a magnetic connection between the lid arm magnet and the receiver in the lid. The method includes replacing the detached toilet lid with a different toilet lid by lowering the different toilet lid into position such that the magnetic connection is reestablished without the use of tools.

DETAILED DESCRIPTION OF THE INVENTION

Figure 1:
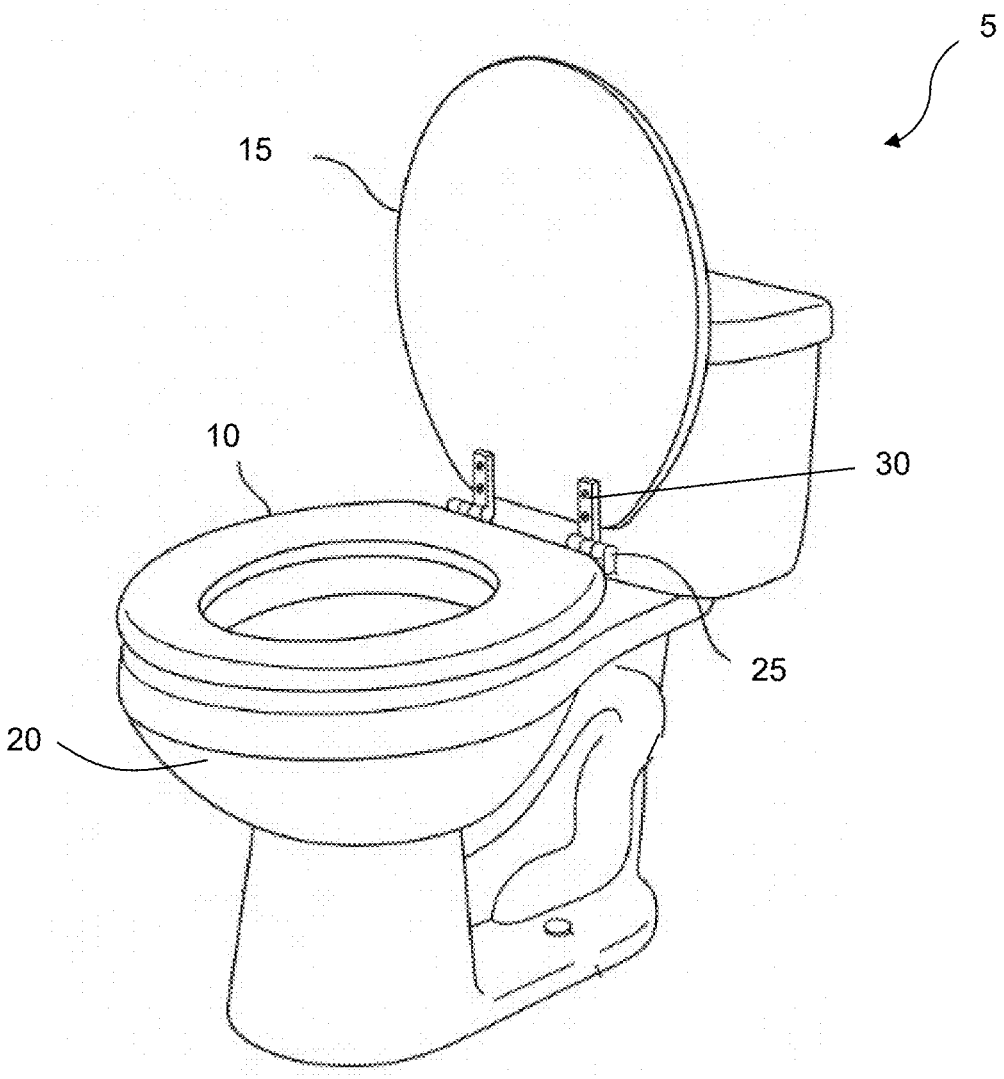
FIG. 1 is a perspective view of a conventional toilet with permanently attached seat and lid.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

The presently disclosed subject matter is directed to a magnetic coupling system for a toilet seat assembly that enables secure attachment of a toilet lid while allowing tool-free removal and replacement. FIG. 1 illustrates a conventional toilet seat assembly 5 that includes toilet seat 10 and lid 15 that are pivotably connected to toilet bowl 20 by a pair of permanently mounted hinge assembly 25. Each hinge assembly 25 includes hinge arm 30 that is fastened to the toilet lid and seat using mechanical hardware, such as screws, bolts, or pins. The hinge assembly is secured to the toilet bowl 20 by mounting posts or brackets that pass through apertures in the bowl and are tightened with nuts or locking fasteners from below. The permanent connection is designed to remain assembled for the lifetime of the toilet seat, and removal generally requires detaching the hardware with tools and disassembling the hinge structure.

Figure 2A:
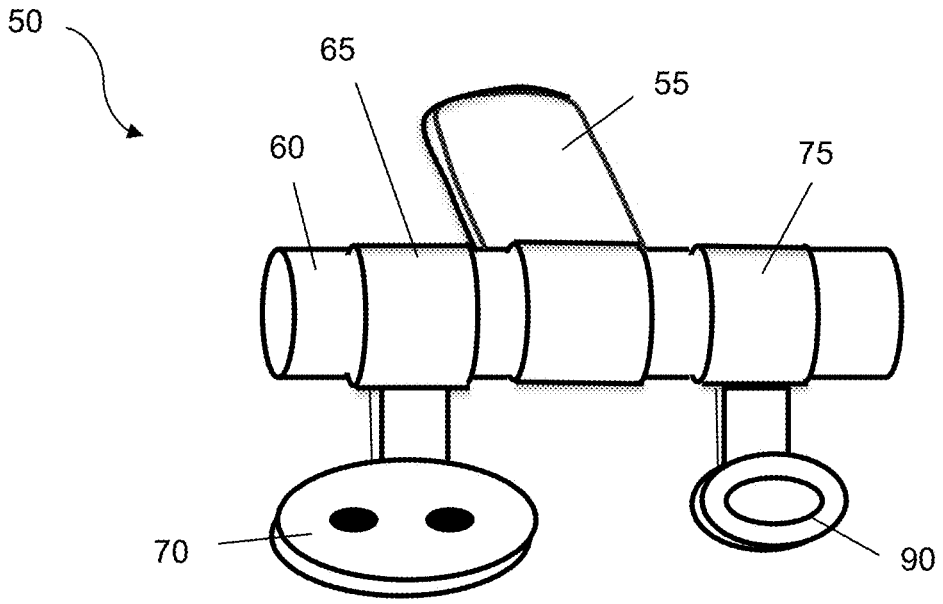
FIG. 2*a* is a perspective view of a hinge assembly in accordance with some embodiments of the presently disclosed subject matter.
Figure 2B:
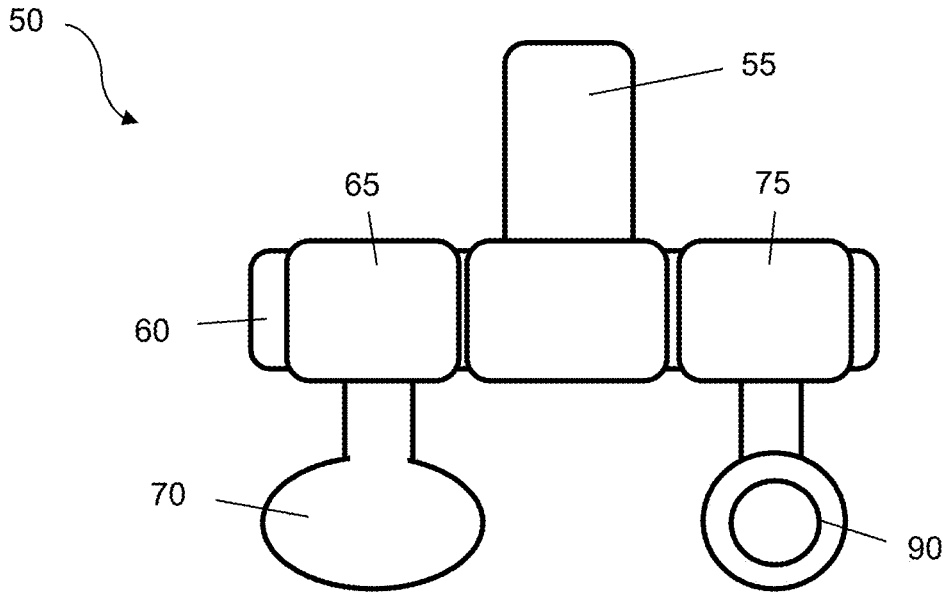
FIG. 2*b* is a top plan view of a hinge assembly in accordance with some embodiments of the presently disclosed subject matter.

The presently disclosed subject matter provides an improved toilet seat assembly that allows a toilet lid to be selectively removed by a user, while the remainder of the assembly is attached to the toilet bowl. As shown in FIGS. 2*a* and 2*b*, hinge assembly 50 connects both the toilet seat and the toilet lid to a rear portion of the toilet bowl, enabling each to pivot upward and downward about a common rotational axis. As shown, the hinge assembly includes central hinge pin 60 that serves as a horizontal axle and defines the pivot axis about which the seat and lid independently rotate between raised and lowered positions. A mounting bracket 55 functions as a pivot support and is permanently secured to the toilet bowl by a mechanical connection, such as bolts extending through apertures formed in the ceramic structure of the bowl. Seat arm 65 is rotatably coupled to hinge pin 60, permitting the toilet seat to pivot relative to the bowl. The seat arm is permanently affixed to the toilet seat via body 70. The hinge assembly further includes lid arm 75 that incorporates magnet 90 configured to cooperate with a corresponding component of the toilet lid, as described in greater detail below. As a result, the toilet seat lid can be quickly and easily removed without the use of tools.

As set forth above, hinge assembly 50 includes hinge pin 60 that serves as the primary structural support of the assembly. The term "hinge pin" refers to an elongate structural element that defines a rotational axis for one or more components of a hinge assembly. The hinge pin can be cylindrical and configured to extend through or be supported by one or more bores, thereby allowing components such as a toilet seat and lid to pivot relative to a fixed toilet bowl, about the axis defined by the pin. The hinge pin can be formed as a single continuous piece or can include multiple segments. Further, the hinge pin can optionally include grooves, caps, and/or retaining elements to enhance stability, prevent axial movement, or facilitate assembly and disassembly.

Figure 3A:
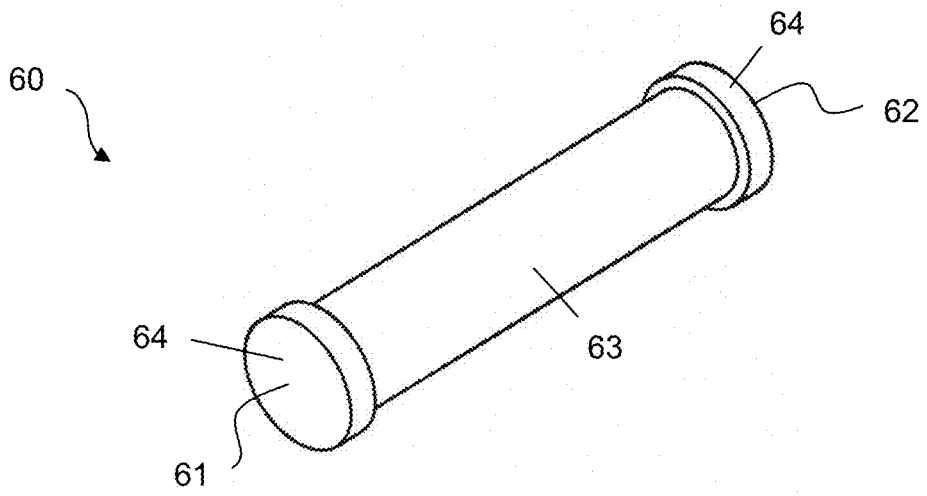
FIG. 3*a* is a perspective view of a hinge pin in accordance with some embodiments of the presently disclosed subject matter.
Figure 3B:
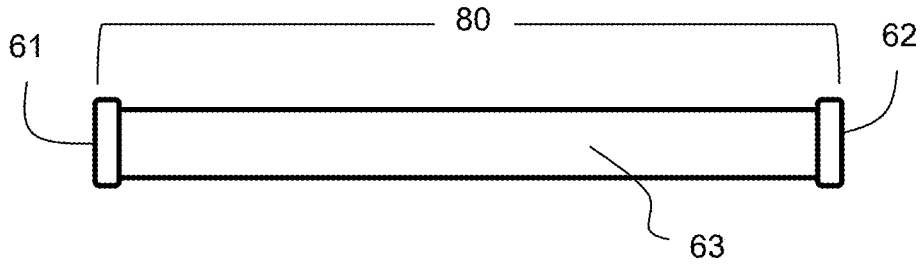
FIG. 3*b* is a side plan view of a hinge pin in accordance with some embodiments of the presently disclosed subject matter.

As illustrated in FIGS. 3*a* and 3*b*, hinge pin 60 includes first end 61 and opposed second end 62, with elongate body 63 extending therebetween. In some embodiments, each end of the hinge pin can include optional cap 64 that retains the hinge pin in position, prevents axial displacement during use, and/or facilitates assembly and disassembly.

Figure 3C:
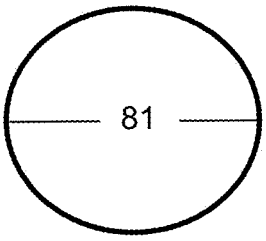
FIG. 3*c* is a cross-sectional view of a hinge pin in accordance with some embodiments of the presently disclosed subject matter.

Hinge pin 60 can have any suitable length depending on the size and configuration of the toilet seat assembly. For example, the hinge pin can have length 80 of about 1 inch to about 10 inches (e.g., at least/no more than about 1, 2, 3, 4, 5, 6, 7, 8, 9, or 10 inches). The term "length" refers to the longest horizontal distance of the hinge pin (e.g., between first and second ends 61, 62). The hinge pin can also include diameter 81, as illustrated in FIG. 3*c*. Diameter 81 can be at least about (or no more than about) 0.1, 0.25, 0.5, 0.75, 1 or 2 inches. As used herein, the term "diameter" refers to the linear distance passing through the center of a generally circular or cylindrical cross-section from one point on the perimeter to the opposite point on the perimeter. In the context of hinge pin 60, diameter 81 represents the width of the hinge pin measured across its cross-section, and it defines the overall size and thickness of the pin in relation to the mounting bracket bores and seat or lid arm bores through which it passes. It should be appreciated that the ranges are not limiting, and the disclosed hinge pin can include a diameter and/or length greater or less than the given ranges.

The central hinge pin 60 serves as the primary structural element of hinge assembly 50 and provides the rotational axis about which both the toilet seat and the toilet lid move. In use, the hinge pin extends laterally across the rear portion of the toilet and is connected to the toilet bowl by one or more mounting brackets 55. The arrangement not only defines a stable pivot point but also distributes mechanical loads evenly across the hinge assembly during use to reduce localized stress and enhance long term durability. The hinge pin 60 further acts as a unifying element that mechanically couples the various components of the hinge assembly 50, including the seat arm and the lid arm, allowing both arms to independently rotate in a controlled and coordinated manner about a common axis.

Thus, the hinge pin provides structural rigidity and alignment to hinge assembly 50, ensuring smooth pivoting motion while maintaining precise positioning of the seat and lid relative to the toilet. Additionally, by serving as a shared rotational axle, the hinge pin simplifies the overall assembly design and minimizes the number of moving parts, thereby improving reliability and ease of manufacture.

As noted above, the disclosed hinge assembly also includes mounting bracket 55 that serves as a support element. The mounting bracket is positioned along the rear deck portion of the toilet bowl and establishes the mechanical interface between the hinge assembly and the fixed ceramic structure of the toilet. The upper rear deck portion 11 of the toilet bowl refers to the generally flat or slightly contoured horizontal surface located at the back of the toilet bowl, behind the water opening and adjacent to where a water tank or flush mechanism is typically mounted. By anchoring hinge pin 60 in a precise location relative to the bowl, the mounting bracket defines the pivot geometry of the seat and lid and ensures reliable, repeatable movement over the life of the product. Without the bracket, the hinge pin would lack the structural stability necessary to sustain repeated dynamic loading associated with daily use.

Figure 4A:
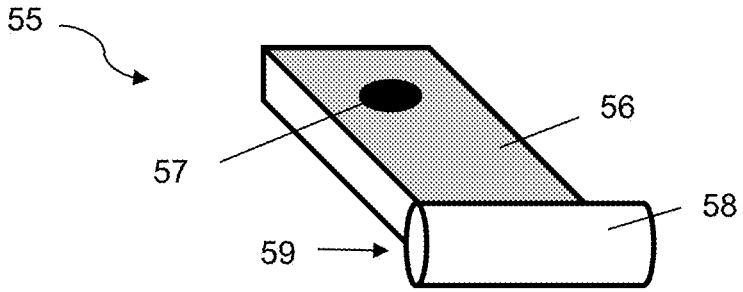
FIG. 4*a* is a perspective view of a mounting bracket in accordance with some embodiments of the presently disclosed subject matter.
Figure 4B:
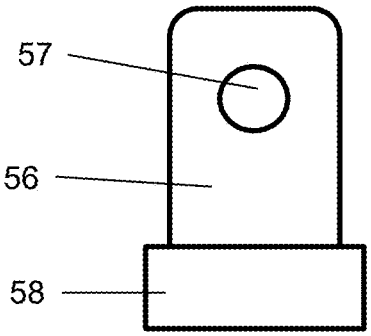
FIGS. 4*b* and 4*c* are top plan views of a mounting bracket in accordance with some embodiments of the presently disclosed subject matter.

As shown in FIGS. 4*a* and 4*b*, mounting bracket 55 includes a support body 56 that includes at least one aperture 57 that extends completely through its thickness. The aperture is configured to receive a fastener, such as a bolt, screw, or similar mechanical attachment device for permanently securing mounting bracket 55 (and thus the overall hinge assembly) to the toilet bowl or other fixed structure. The secure attachment provided by aperture 57 ensures that the hinge assembly remains stable under repeated load conditions during normal operation.

Mounting bracket 55 further includes cylindrical bore 58 formed transversely through the main body of the bracket. As used herein, the term "bore" refers to a passageway (e.g., cylindrical passageway) that is sized and shaped to receive the hinge pin and permit its insertion, positioning, and rotational support. A bore can serves as a bearing surface that allows the seat arm and lid arm to pivot smoothly about the hinge pin while maintaining proper alignment along the rotational axis.

Thus, the mounting bracket bore is dimensioned to receive hinge pin 60 that extends through the internal bore passageway 59 to define the rotational axis of the hinge assembly. The interface between bore 58 and hinge pin 60 permits smooth rotational motion of the toilet seat and lid while maintaining precise alignment of the hinge components. In some embodiments, the inner surface of the bore passageway can include bearing features, low-friction coatings, and/or retention elements to further enhance pivot performance and reduce wear over time.

It should be understood that mounting bracket 55 is not limited to the particular shape or geometry illustrated in FIGS. 4*a* and 4*b*. While a generally rectangular configuration is shown for purposes of example, the mounting bracket can assume any of a wide variety of shapes, contours, or profiles without departing from the scope of the invention. For instance, the bracket may be formed with a cylindrical, oval, polygonal, or contoured profile to accommodate different design requirements, manufacturing techniques, and/or aesthetic considerations. In some embodiments, the bracket may include curved or tapered surfaces to improve load distribution, reduce material usage, and/or integrate seamlessly with the shape of the toilet bowl. Other embodiments may incorporate flanges, reinforcing ribs, or integrated fastening features. Regardless of its external geometry, the mounting bracket functions to secure the hinge pin in place, provide a stable pivot point, and anchor the hinge assembly to the toilet structure.

Figure 4C:
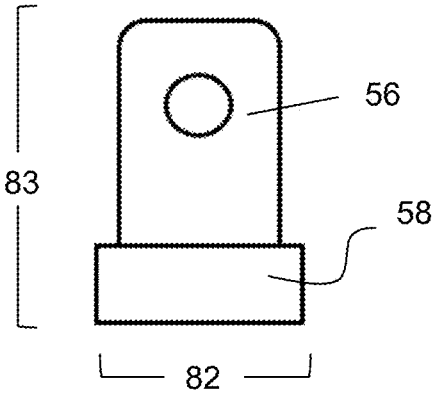
Figure 4D:
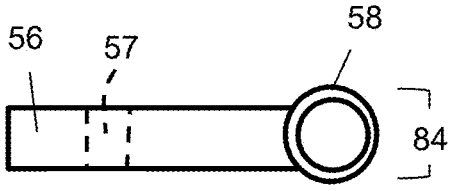
FIG. 4*d* is a side plan view of a mounting bracket in accordance with some embodiments of the presently disclosed subject matter.

The dimensions of mounting bracket 55, including its length, width, and thickness, are not limited to any particular values and can vary depending on the size of the toilet seat assembly, the desired load-bearing capacity, manufacturing considerations, or other design constraints. For example, the bracket can have length 82 of about 0.25 to 6 inches, width 83 of about 0.25 to 6 inches, and thickness 84 of about 0.1 to 2 inches, as illustrated in FIGS. 4*c* and 4*d*. Other embodiments may fall outside these ranges depending on the application. For example, larger or reinforced brackets can be used in commercial or heavy-duty installations, while smaller, lightweight brackets can be used in residential or compact toilet designs. The presently disclosed subject matter is not intended to be limited to any particular set of dimensions, and the mounting bracket can be scaled or proportioned as necessary to achieve the desired structural and functional characteristics.

The size and geometry of mounting bracket bore 58 are likewise not limited to any particular dimensions and can be adapted to suit different hinge pin sizes, material properties, and design requirements. In some embodiments, bore 58 can have a diameter ranging from about 0.1 inches to about 2 inches, such as from about 0.25 inches to about 1 inch in typical residential applications. In certain configurations, the bore can be circular to accommodate a cylindrical hinge pin. However, the bore can be elliptical, polygonal, or otherwise shaped to interface with a non-cylindrical or keyed hinge pin profile. The length of bore 58, corresponding to the length of the mounting bracket, can also vary from about 0.1 inches to about 6 inches, depending on the desired level of structural support and the overall thickness of the bracket. However, it should be appreciated that the noted dimensions are merely illustrative, and the bore can be scaled or modified as needed to ensure proper alignment, secure retention, and smooth rotational motion of the hinge pin within the bracket.

Secure attachment of mounting bracket 55 to the toilet bowl ensures the proper function of hinge assembly 50. For example, the bracket can be permanently affixed using mechanical fasteners (such as bolts or screws) that pass through aperture 57 and into corresponding holes or anchors within the ceramic or polymeric structure of the toilet bowl. The attachment of the mounting bracket to the toilet bowl transfers loads generated during use (such as downward force from a seated user or impact from lid closure) directly to the bowl, preventing stress concentrations in the hinge pin or associated components. In alternative embodiments, the bracket can be bonded to the bowl using high-strength adhesives, snap-fit engagement features, and/or integrated bosses molded directly into the toilet structure.

Mounting bracket 55 can be produced as a single, unitary component or as a modular, multi-piece assembly depending on manufacturing and installation requirements. Regardless of configuration, the bracket anchors hinge pin 60 to the toilet, aligns the rotational axis of the toilet seat and lid, and provides the structural foundation that enables reliable, long-term operation of the disclosed magnetic hinge assembly.

Figure 4E:
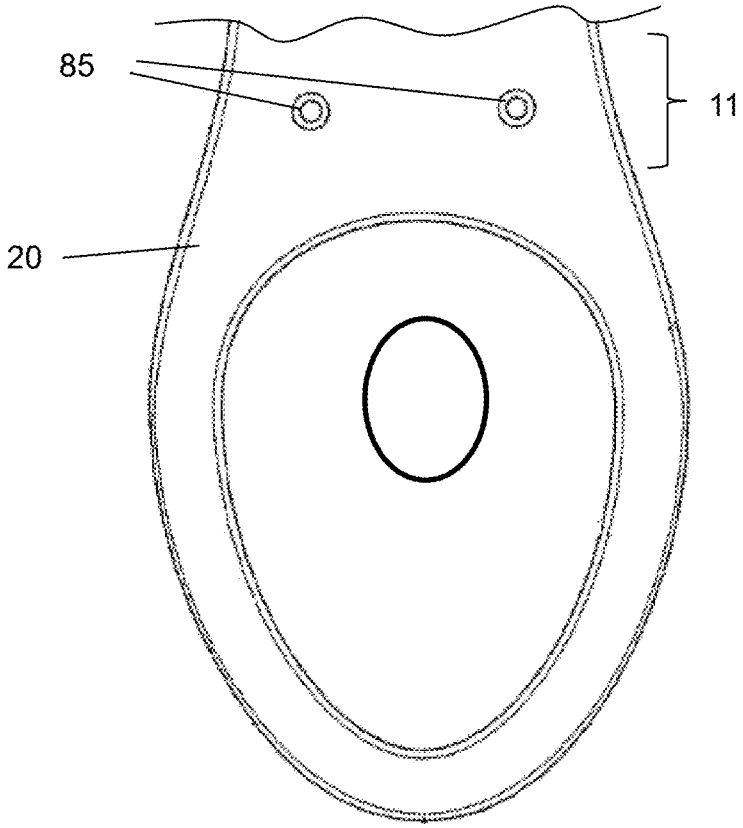
FIG. 4*e* is a top plan view of a toilet bowl in accordance with some embodiments of the presently disclosed subject matter.
Figure 4F:
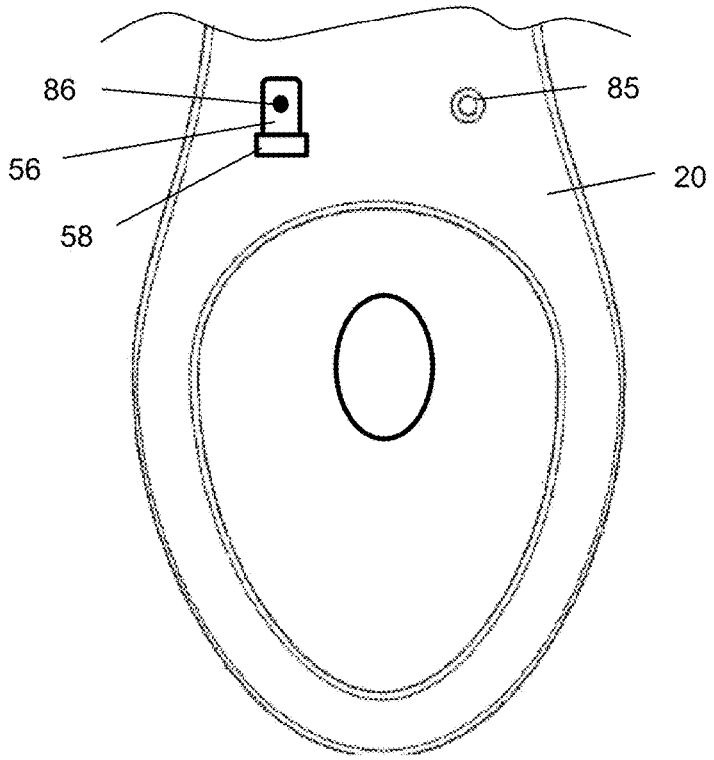
FIG. 4*f* is a top plan view of a toilet bowl with an attached mounting bracket in accordance with some embodiments of the presently disclosed subject matter.

As shown in FIGS. 4*e* and 4*f*, mounting bracket 55 can positioned such that aperture 57 is aligned with pre-formed mounting hole 85 formed in the body of toilet bowl 20. Once properly positioned, fastener 86 (such as a screw, bolt, rivet, or other mechanical connector) is inserted through mounting bracket aperture 57 and into toilet mounting hole 85, thereby creating a permanent or semi-permanent mechanical connection between the mounting bracket and the toilet structure. The connection securely anchors the hinge assembly to the toilet, ensuring that rotational forces generated during normal seat and lid movement are reliably transferred to the toilet bowl without loosening or shifting over time. Often, a toilet will includes two mounting holes such that two hinge assemblies can be positioned and attached to a single toilet to provide enhanced balance and load distribution.

As discussed in detail above, the disclosed hinge assembly also includes seat arm 65 positioned at a first end of the hinge pin. Seat arm 65 serves as the mechanical interface between the hinge pin 60 and toilet seat 10, transmitting the rotational motion of the hinge pin into controlled pivoting of the seat about a horizontal axis. Seat arm 65 is configured to securely couple to hinge pin 60 while simultaneously providing a connection to the toilet seat structure.

Figure 5A:
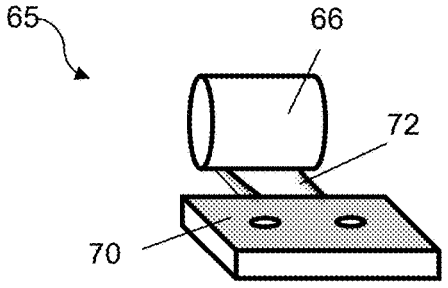
FIG. 5*a* is a perspective view of a seat arm in accordance with some embodiments of the presently disclosed subject matter.
Figure 5B:
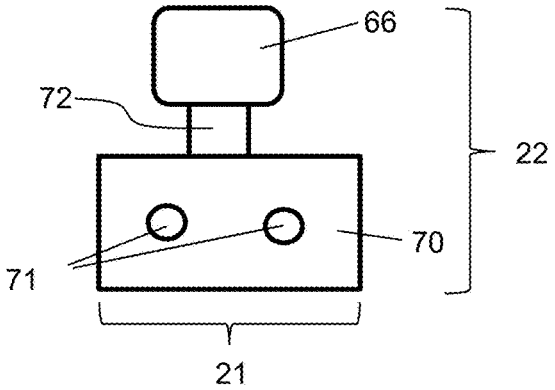
FIG. 5*b* is a top plan view of a seat arm in accordance with some embodiments of the presently disclosed subject matter.

As shown in FIGS. 5*a* and 5*b*, seat arm 65 includes seat arm bore 66 that can be configured as a generally cylindrical or semi-cylindrical passageway to receive and engage hinge pin 60. In this way, the seat arm is permitted to rotate freely about the hinge axis during normal operation. Stated another way, the toilet seat can be raised and lowered. The bore may be dimensioned for a close-tolerance fit around the hinge pin to reduce wobble or excessive play, while still allowing smooth pivoting motion. In some embodiments, bushings, liners, or low-friction coatings may be included to enhance wear resistance and ensure consistent rotational performance over time.

As shown, seat arm body 70 extends outward from bore 66. Arm body 70 includes one or more seat arm apertures 71 (e.g., two apertures) that extend through the thickness of the arm body. The apertures are configured to receive mechanical fasteners (such as screws, bolts, or rivets) that pass through the arm body and into corresponding holes on the underside of toilet seat 10. The mechanical attachment creates a secure, load-bearing connection between seat arm 65 and the toilet seat, ensuring that forces exerted during use are effectively transmitted through the hinge assembly without loosening or failure.

Neck 72 connects hinge bore 66 to arm body 70, thereby providing structural continuity and strength between the rotational interface and the fastening region. The neck can be integrally formed with both the bore and the body and can have a curved or stepped profile to reduce stress concentrations and improve the distribution of mechanical loads. In some embodiments, the neck can include reinforcement ribs, fillets, or gussets to further enhance durability.

Figure 5C:
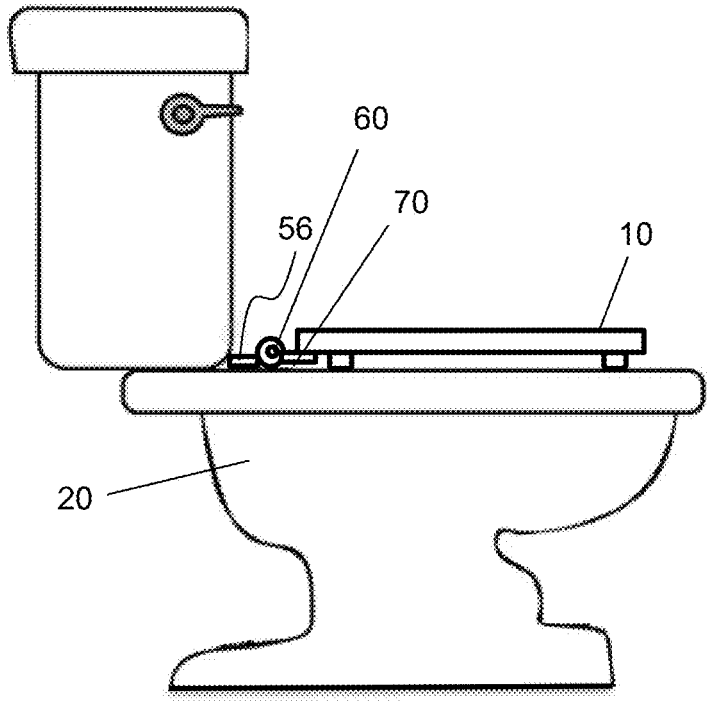
FIG. 5*c* is a side view of a toilet bowl and seat with a mounting bracket and seat arm attached in accordance with some embodiments of the presently disclosed subject matter.

As shown in FIG. 5*c*, seat arm 65 can be secured to the underside of toilet seat 10 (e.g., the surface that faces downward toward the toilet bowl when the seat is in a lowered position) while mounting bracket 55 is simultaneously attached to the toilet bowl 20. In this configuration, hinge pin 60 extends through the bore 58 of mounting bracket 55 and the bore 66 of seat arm 65, thereby coupling the two components into a unified hinge structure. This arrangement allows the toilet seat 10 to pivot upward and downward around the hinge pin while remaining firmly anchored to the toilet bowl. The combination of the bore engagement, fastener attachment, and structural transition region ensures that seat arm 65 provides both mobility and stability, maintaining the integrity and functionality of the hinge system over extended periods of use.

The configuration of seat arm 65 in combination with hinge pin 60 and mounting bracket 55, enables toilet seat 10 to be raised and lowered smoothly and with minimal effort. Because bore 66 is dimensioned to permit low-friction rotation around hinge pin 60, and because the pivot axis is precisely aligned by the interaction of the seat arm and mounting bracket, the seat moves between its raised and lowered positions in a controlled, stable manner without excessive play or wobble. The ease of movement enhances user comfort and convenience and reduces wear on the hinge components over time. In some embodiments, friction-reducing coatings, bushings, or bearings can be incorporated into the support arm bore to further improve pivot smoothness and extend the operational life of the assembly.

Figure 5D:
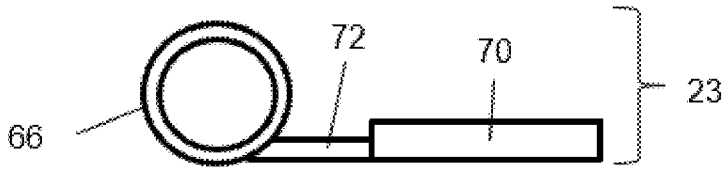
FIG. 5*d* is a side plan view of a seat arm in accordance with some embodiments of the presently disclosed subject matter.

As shown in FIGS. 5*b* and 5*d*, the seat arm can have any suitable dimensions, such as (but not limited to) length 21, width 22, and/or thickness 23 of about 0.5-5 inches (e.g., at least/no more than about 0.5, 1, 2, 3, 4, or 5 inches). However, the presently disclosed subject matter is not limited and the seat arm can be configured larger or smaller than the noted range.

Lid arm 75 provides the structural interface between hinge pin 60 and toilet lid 15.

Figure 6A:
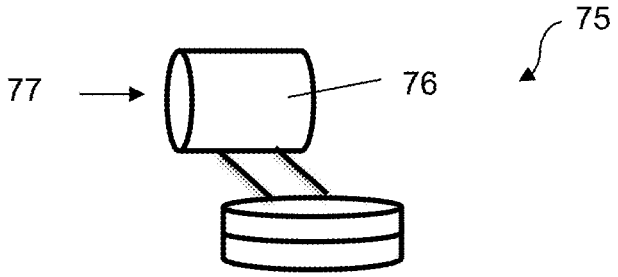
FIG. 6*a* is a perspective view of a lid arm in accordance with some embodiments of the presently disclosed subject matter.
Figure 6B:
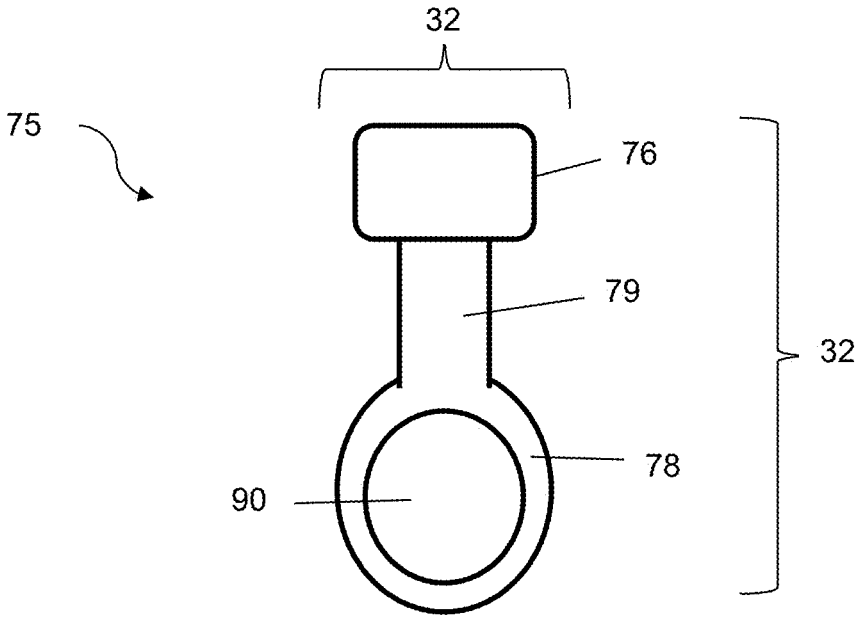
FIG. 6*b* is a top plan view of a lid arm in accordance with some embodiments of the presently disclosed subject matter.

The lid arm is configured to enable rotational movement and provide a magnetic connection that allows the toilet lid to be easily attached and detached from the hinge assembly. As shown in FIGS. 6*a* and 6*b*, lid arm 75 includes lid arm hinge bore 76 dimensioned to receive hinge pin 60 within internal bore passageway 77. The lid arm bore cooperates with the hinge pin to permit the lid arm to pivot smoothly about the hinge axis during opening and closing of the toilet lid. The bore can optionally include low-friction or wear-resistant surfaces to reduce binding and enhance operational life.

Lid arm body 78 forms the primary structural portion of lid arm 75. As shown, the arm body 78 is joined to the bore by a narrowed neck 79 that serves as a transition region between the bore and the main body. The neck positions the lid arm body relative to the bore and supports the structural integrity of the lid arm while allowing the body to extend outward to interface with other components of the hinge assembly.

The lid arm can include length 31, width 32, and thickness 33 of about 0.5-6 inches (e.g., at least/no more than about 0.5, 1, 2, 3, 4, 5, or 6 inches). However, it should be appreciated that the dimension are non-limiting and the lid arm can be configured outside the noted ranges.

Lid arm 75 includes magnet 90 embedded within or mounted on the distal portion of the arm body 78. In some embodiments, the magnet can be a high-strength rare earth magnet, such as a neodymium magnet. As used herein, the term "magnet" refers to a material or component that produces a magnetic field capable of exerting attractive or repulsive forces on ferromagnetic materials or other magnetically responsive elements. A magnet may be formed as a permanent magnet (i.e., retaining a magnetic field without the need for an external power source) or as an electromagnet that generates a magnetic field when electrical current is applied. For example, the magnet can be a permanent magnet configured to attract and retain a corresponding ferromagnetic element within the lid receiver groove.

As used herein, the term "neodymium magnet" refers to a type of rare-earth permanent magnet composed primarily of an alloy of neodymium, iron, and boron (NdFeB). Neodymium magnets are known for their exceptionally high magnetic strength relative to their size, enabling compact magnetic components to provide strong holding forces. Due to the high magnetic strength and stability, neodymium magnets are particularly suited for use in compact hinge assemblies where reliable, removable attachment is desired.

Figure 6C:
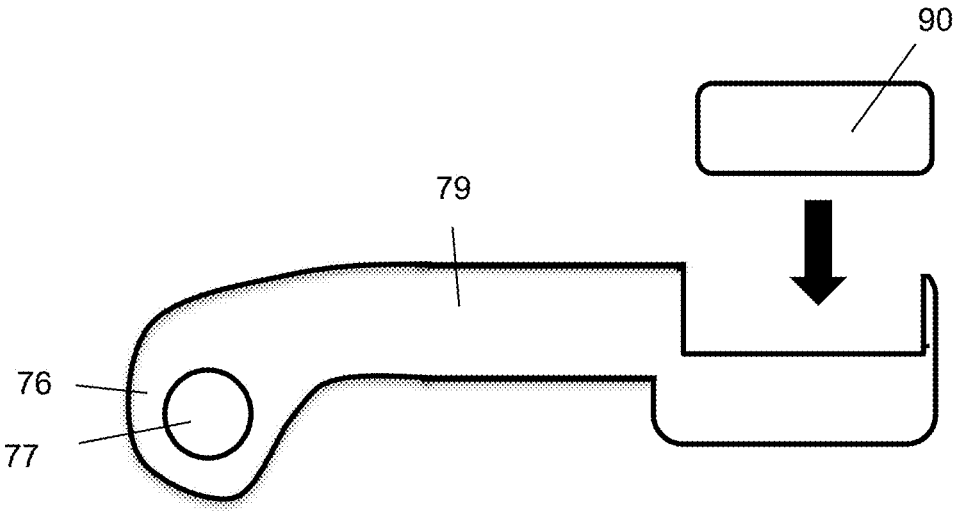
FIGS. 6*c* and 6*d* are side plan views of seating a magnet in a lid arm in accordance with some embodiments of the presently disclosed subject matter.
Figure 6D:
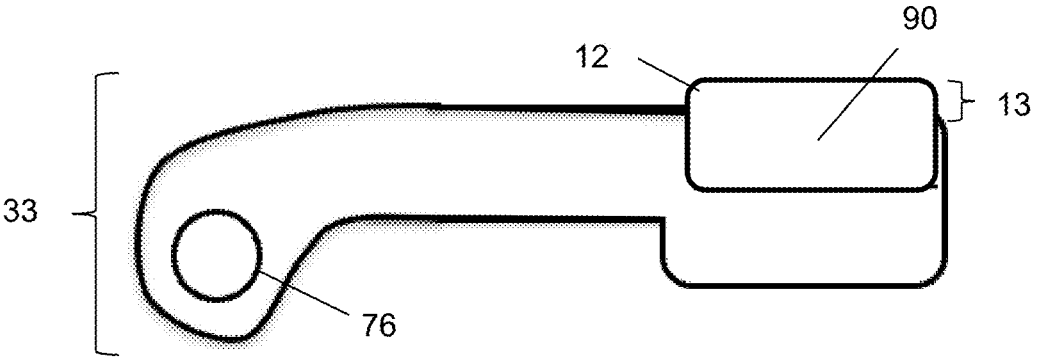

Magnet 90 extends slightly above the upper surface of lid arm body 78 so that it can engage with a receiver groove 91 formed in the underside of toilet lid 14, as shown in FIGS. 6*c* and 6*d*. For example, when the lid is positioned on lid body 78, the magnet can include extending lip 12 with a height 13 of about 0.05-0.5 inches (e.g., 0.05, 0.1, 0.2, 0.3, 0.4, or 0.5 inches).

Figure 6E:
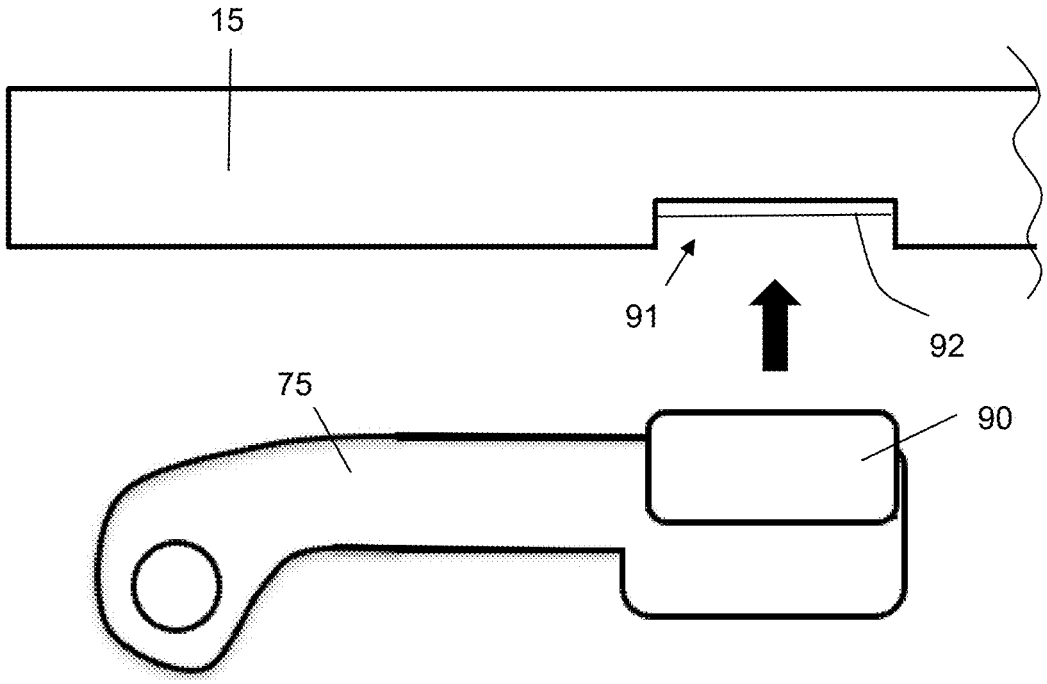
FIGS. 6*e* and 6*f* are side plan views of connecting a lid arm to a toilet seat in accordance with some embodiments of the presently disclosed subject matter.
Figure 6F:
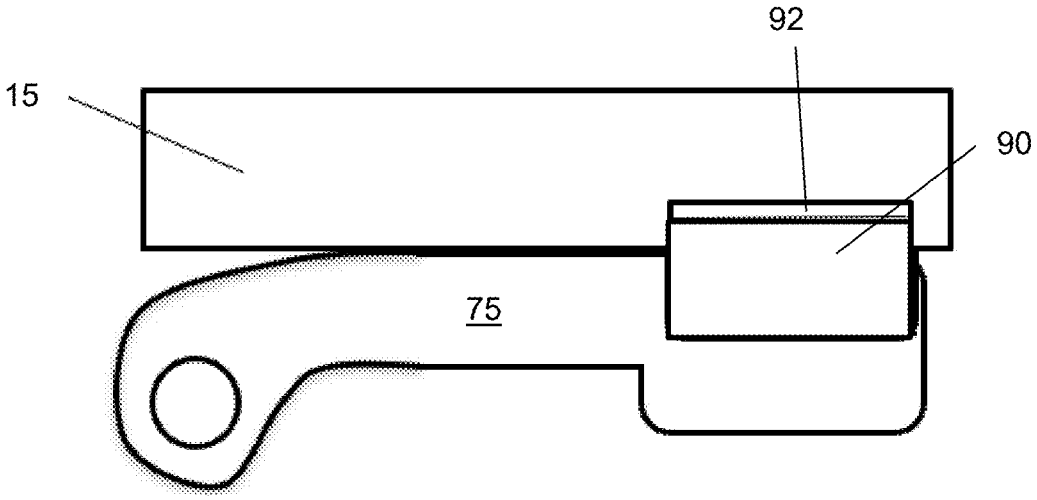

Within the interior of lid groove 91 is a magnetically responsive element 92 which in some embodiments can be a coated metal disc. Element 92 is configured to cooperate with magnet 90, thereby forming a secure magnetic attachment, as shown in FIGS. 6*e* and 6*f*. The magnetic engagement allows the toilet lid to be removably coupled to the hinge assembly. In this way, toilet lid 15 can be installed or removed by simply aligning the groove with the magnet and lifting upward when removal is desired.

The receiver component within the lid (such as coated metal disc 92 or a similar element) can be formed from a magnetically responsive material capable of being attracted to magnet 90 and establishing a reliable magnetic coupling. Suitable materials include ferromagnetic metals such as iron or low-carbon steel that offer strong magnetic permeability and cost-effective performance. Certain grades of stainless steel can also be used (e.g., ferritic or martensitic alloys), providing both corrosion resistance and magnetic responsiveness. Other examples include nickel, cobalt, and nickel-iron alloys that deliver enhanced magnetic strength and stability, enabling the use of smaller or more compact magnetic components without sacrificing holding force. In some embodiments, the magnetically responsive element can optionally be coated or plated (e.g., with zinc, nickel, epoxy, or a polymeric layer) to resist corrosion, reduce friction, or improve compatibility with the surrounding lid structure while maintaining their magnetic properties.

Figure 7A:
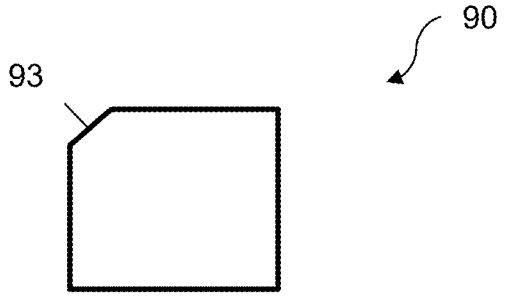
FIG. 7*a* is a cross-sectional view of a lid arm magnet in accordance with some embodiments of the presently disclosed subject matter.

As shown in FIG. 7*a*, magnet 90 can include a beveled edge 93, for example having a 3-5 degree taper, that provides a tight, sealed fit within groove 91 when the lid is attached. As used herein, the term "beveled edge" refers to an angled or sloped surface formed along the perimeter of a component, rather than a perpendicular or square edge. In the context of magnet 90, the beveled edge 93 is defined as a circumferential taper, typically between about 3 degrees and 5 degrees relative to the vertical sidewall of the magnet. The angled geometry serves several functional purposes. For example, it guides the magnet into precise alignment with the corresponding groove 91 during lid installation, facilitates smooth insertion and removal without binding, and enhances the contact interface to form a tighter and more stable mechanical and magnetic connection. Additionally, the beveled profile helps create a partial seal at the interface, reducing the likelihood of moisture or debris infiltrating the magnetic connection point, which improves reliability and durability over repeated use.

Figure 7B:
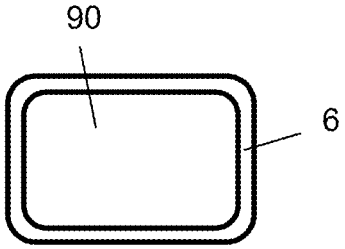
FIG. 7*b* is a cross-sectional view of a coated magnet in accordance with some embodiments of the presently disclosed subject matter.

In some embodiments, the magnet can include optional coating 6 (e.g., a non-porous corrosion-resistant layer selected from nickel, epoxy, or polymeric coatings), as shown in FIG. 7*b*.

Figure 8:
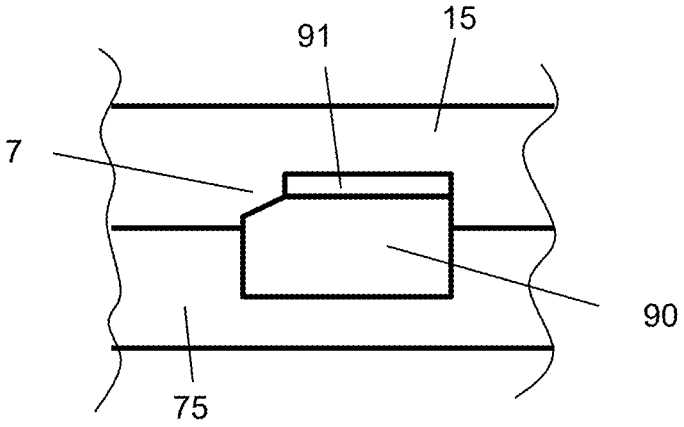
FIG. 8 is a fragmentary view of a lid and lid arm connection in accordance with some embodiments of the presently disclosed subject matter.

As shown in FIG. 8, the lid arm body can include a beveled guide surface 7 surrounding the magnet and configured to guide the receiver into alignment during installation of the toilet lid.

The magnetic interface provides significant advantages over conventional hinge designs. Because the toilet lid is magnetically coupled rather than permanently fastened, it can be removed for cleaning, repair, or replacement without the need for tools or disassembly of the hinge assembly. Further, the magnetic connection is strong enough to maintain secure attachment during repeated cycles of opening and closing. In some embodiments, multiple magnets can be used or arranged in arrays to increase holding force or to provide self-centering functionality when the lid is installed.

It should be understood that the specific configuration of lid arm 75 and magnet 90 described herein is merely exemplary and that numerous variations are possible without departing from the spirit and scope of the invention. For example, while a single neodymium magnet is illustrated, other types of magnets can be used. In some embodiments, multiple magnets can be embedded within the arm body 78 to increase holding force or to provide a distributed magnetic field that enhances alignment of the lid. Likewise, the receiver structure within lid groove 91 may include one or more ferromagnetic plates, rings, or embedded inserts positioned at various depths or angles to tailor the retention characteristics. The groove and/or magnet can have any shape, such as itself can circular, oval, square, triangular, octagonal, hexagonal, pentagonal rectangular, or non-linear in profile, and may include alignment ridges, sealing gaskets, or resilient liners to further improve fit and environmental resistance. The beveled geometry of magnet 90 can also vary, with different taper angles or stepped profiles used to achieve particular engagement characteristics. These and other variations are considered to be within the scope of the present disclosure, provided they allow for a removable magnetic attachment between lid arm 75 and the toilet lid 15.

In some embodiments, the components of hinge assembly 50, including the mounting bracket, hinge pin, seat arm, and lid arm, can be manufactured from any suitable material capable of providing the desired structural strength, durability, corrosion resistance, and functionality. Suitable materials include metals (such as stainless steel, aluminum, brass, zinc alloys, and titanium), polymeric materials (such as nylon, acetal, polycarbonate, or reinforced polymers) and/or and composite materials such as fiber-reinforced plastics or metal-polymer hybrids. In some embodiments, different components may be formed from different materials to optimize performance. For example, the hinge pin may be constructed from metal for strength, while the arms may be molded from a corrosion-resistant polymer to reduce weight and cost. Coatings, surface treatments, and/or finishes (such as anodizing, plating, or polymer overmolding) may also be applied to further enhance corrosion resistance, wear resistance, or aesthetic appearance.

The hinge assembly described herein may be installed on a standard toilet and seat assembly using conventional tools and installation procedures. The following description outlines one exemplary method of installation, though it should be appreciated that variations in order, components, or attachment techniques may be used without departing from the scope of the invention.

Figure 9:
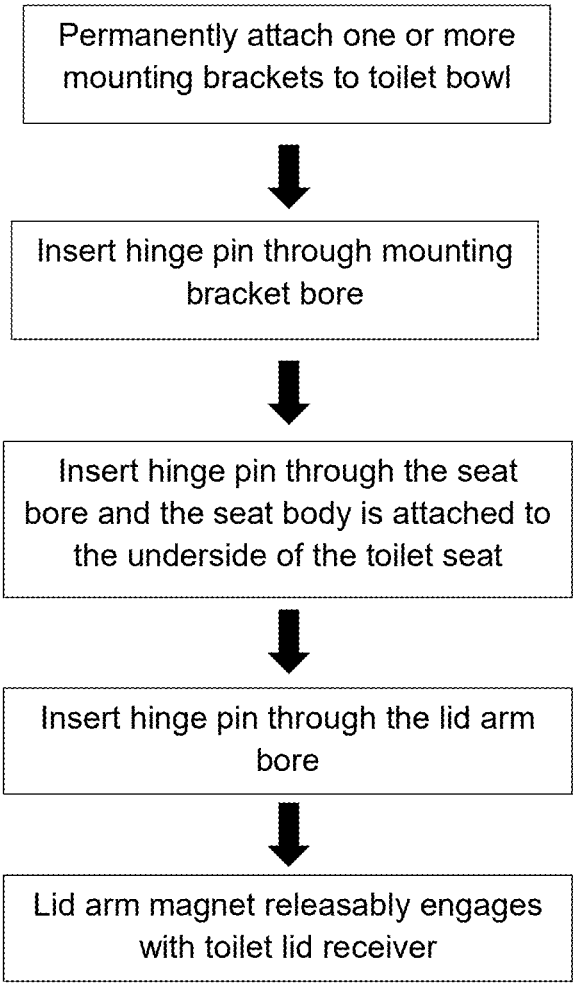
FIG. 9 is a schematic of one method of installing a hinge assembly in accordance with some embodiments of the presently disclosed subject matter.

In one embodiment, installation begins by positioning mounting bracket 55 on the upper rear deck portion of toilet bowl 20, as shown in the schematic of FIG. 9. The upper rear deck portion of a toilet bowl is the flat, horizontal surface located at the back of the toilet bowl, typically extending between and above the rear hinge mounts, and serving as the support platform on which the toilet seat assembly and lid are mounted. The mounting brackets can be oriented so that mounting bracket leg apertures 57 align with corresponding pre-formed mounting holes 85 in the ceramic structure of the toilet bowl. Once aligned, mechanical fasteners 86 can be inserted through the apertures and tightened to securely fix each mounting bracket to the bowl. The hinge assembly is then firmly anchored to the toilet and establishes the rotational axis upon which both the toilet seat and toilet lid can pivot. In some embodiments, a pair of mounting brackets is installed in a spaced-apart arrangement to provide balanced support for the hinge pin.

Next, hinge pin 60 is inserted through bore 58 formed in the mounting bracket, thereby forming a continuous pivot axle. Once in place, seat arm 65 is positioned so that seat bore 66 aligns coaxially with hinge pin 60, and the seat arm is then slid into engagement with the hinge pin. The underside of toilet seat 10 is then positioned against the arm body 70 of the seat arm, and mechanical fasteners are inserted through apertures 71 to secure the seat arms to the seat. The attachment establishes a structural connection between the seat and hinge assembly, enabling smooth upward and downward pivoting of toilet seat 10 about hinge pin 60.

With the seat portion installed, the lid arm 75 is mounted in a similar manner. The lid arm is aligned so that lid arm bore 76 receives hinge pin 60, allowing the arm to rotate about the same pivot axis. The toilet lid 15 is then positioned above the hinge assembly such that the receiver groove 91 formed on the lid underside aligns with the magnet 90 held within each lid arm. The lid is lowered until magnet 90 engages with the ferromagnetic inserts or coated metal discs 92 within the grooves, forming a secure magnetic attachment between the lid and hinge assembly. Because the magnetic connection is releasable, the lid can be installed or removed without the use of tools, simply by lowering it into position or lifting it upward.

After installation, both the toilet seat 10 and lid 15 can be raised and lowered easily about the common pivot axis defined by hinge pin 60. The disclosed hinge assembly 50 remains securely anchored to the toilet structure, and the magnetic interface ensures that the lid remains attached during normal use while still permitting quick removal for cleaning, repair, or replacement. The disclosed installation method provides a simple and intuitive process that can be completed with minimal tools and expertise, offering significant advantages over conventional hinge systems that rely on permanent fasteners for both the seat and lid.

The hinge assembly described herein is specifically designed to allow the toilet lid 15 to be easily removed and reinstalled by a user without tools, thereby significantly improving ease of cleaning, maintenance, and customization compared to conventional hinge systems. In normal operation, the toilet seat 10 and lid 15 can independently pivot about hinge pin 60 as the user raises or lowers them. However, because the lid is magnetically coupled to lid arm 75 rather than permanently affixed, the user may selectively detach the lid at any time without disturbing the rest of the hinge assembly.

To remove the lid, the user first raises the lid 15 into an upright or partially upright position to provide access to the interface between the underside of the lid and the lid arm 75. The user then applies an upward force sufficient to overcome the magnetic attraction between magnet 90 and the corresponding ferromagnetic inserts or coated metal discs 92 within receiver groove 91. As the magnetic engagement is released, the lid lifts free of the hinge assembly, leaving the toilet seat 10 and the remainder of the hinge components undisturbed. The removal process requires no tools, mechanical disassembly, or detachment of the hinge pin, allowing a typical user to complete it in seconds.

Once removed, the toilet lid may be thoroughly cleaned on all surfaces, thereby improving hygiene and simplifying routine maintenance. Additionally, the removable configuration enables the user to replace the lid entirely, for example, by installing a decorative or seasonal lid, a lid made of a different material, or a replacement lid in the event of damage.

To reinstall the toilet lid, a user aligns the receiver groove 91 on the underside of the lid with the corresponding magnet 90 on lid arm 75 and lowers the lid into place. The beveled profile of magnet 90 naturally guides the lid into proper alignment, and the magnetic attraction draws the lid downward until it seats securely against the arm bodies. Once engaged, the lid is held firmly in place and can be used in the same manner as a permanently mounted lid, while still remaining removable at any time.

The removable functionality of toilet lid 15 represents a significant improvement over traditional hinge systems that require the lid to be permanently attached by screws or bolts and must be fully disassembled for removal. Thus, hinge assembly 50 not only simplifies cleaning and maintenance but also provides the user with greater flexibility in customizing the appearance or features of their toilet lid without requiring specialized tools or professional assistance.

The disclosed hinge assembly provides many benefits over conventional toilet structures. Specifically, the magnetic coupling between the lid arm and toilet lid allows the lid to be detached and reinstalled without the use of tools. As a result, cleaning, maintenance, and replacement are significantly faster and more convenient for the user.

Because the lid can be removed entirely, users can access all surfaces of the seat, lid, and bowl area for thorough cleaning. Thus, bacterial buildup is reduced, and overall bathroom hygiene is improved compared to systems with permanently attached lids.

Users can easily replace the standard toilet lid with a decorative, seasonal, or upgraded version, enabling customization without the need to replace the entire hinge assembly.

The hinge assembly is designed for straightforward installation using standard fasteners and pre-existing mounting holes. Once installed, the hinge pin, seat arm, and lid arm integrate seamlessly to provide a stable pivot structure.

The alignment of the hinge pin, mounting bracket, and seat arm ensures low friction pivoting of both the seat and lid, allowing them to be raised and lowered smoothly and without excessive play.

The robust attachment of the mounting brackets to the toilet bowl, combined with the reinforced design of the seat and lid arms, improves load distribution and reduces mechanical stress, resulting in a long-lasting hinge system.

The use of a beveled, coated neodymium magnet provides a strong, reliable connection between the lid arm and the lid while still permitting easy removal. The beveled fit also seals the interface, reducing moisture ingress and wear.

The modular nature of the hinge components (mounting brackets, hinge pin, seat arm, and lid arm) allows the system to be adapted to a wide range of toilet geometries and seat styles without significant modification.

Because the lid and certain hinge components can be removed or replaced individually, users can service or upgrade the assembly without replacing the entire toilet seat system.

By combining stability, ease of installation, removability, and smooth operation, the hinge assembly provides a more user-friendly, versatile, and hygienic solution than conventional toilet hinge designs.

The intuitive, tool-free magnetic connection makes the hinge assembly exceptionally easy to operate, even for users with limited strength, dexterity, or mobility. Because the lid can be removed and reinstalled simply by lifting it upward or lowering it into place (e.g., without screws, clips, or complex mechanisms), children, elderly individuals, and users with physical limitations can clean, replace, or customize the toilet lid independently and safely. This feature significantly broadens the usability of the product compared to conventional hinge systems, which often require tools and substantial effort to disassemble.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A hinge assembly for a toilet seat and lid, comprising:

a hinge pin comprising a first end, a second end, and a body extending therebetween;

a mounting bracket configured to be secured to an upper rear deck portion of a toilet bowl, the mounting bracket comprising:

a bracket body defined by at least one aperture configured to position and support the mounting bracket relative to the toilet bowl;

a bracket bore positioned at one end of the bracket body and configured to receive the hinge pin;

a seat arm comprising:

a seat arm bore configured to receive the hinge pin and allow rotation of the seat arm about the hinge pin;

a seat arm body comprising one or more apertures configured to receive mechanical fasteners to secure the seat arm to a toilet seat; and a seat arm neck extending between the seat arm bore and the seat arm body to structurally connect the seat arm bore and the seat arm body;

a lid arm comprising:

a lid arm bore configured to receive the hinge pin and allow rotation of the lid arm about the hinge pin;

a lid arm body extending from the lid arm bore and comprising a magnet projecting above an upper surface of the lid arm body and configured to magnetically engage a receiver disposed in a toilet lid; and a lid arm neck extending between the lid arm bore and the lid arm body to structurally connect the lid arm bore and the lid arm body;

wherein the hinge pin, seat arm, and lid arm cooperate to allow the toilet seat and lid to pivot upward and downward about a rotational axis, and wherein the magnet and the receiver are configured such that the lid is removably attachable to the lid arm by magnetic attraction between the magnet and the receiver without the use of tools.

2. The hinge assembly of claim 1, wherein the magnet is a neodymium magnet.

3. The hinge assembly of claim 1, wherein the receiver comprises a coated ferromagnetic insert positioned within a groove on an underside of the toilet lid.

4. The hinge assembly of claim 1, wherein the magnet includes a beveled edge configured to form a sealed fit with the receiver.

5. The hinge assembly of claim 4, wherein the beveled edge has an angle of about 3° to about 5°.

6. The hinge assembly of claim 1, wherein the magnet extends above an upper surface of the lid arm to project into the receiver when the lid is installed.

7. The hinge assembly of claim 1, wherein the hinge pin is cylindrical.

8. The hinge assembly of claim 1, wherein the magnet is coated with a non-porous corrosion-resistant layer selected from nickel, epoxy, or polymeric coatings.

9. The hinge assembly of claim 1, wherein the wherein the receiver and the magnet are shaped to self-center during engagement, thereby ensuring proper alignment of the toilet lid without manual positioning.

10. The hinge assembly of claim 1, wherein the magnet and the receiver are configured to generate a magnetic holding force of between about 5-20 newtons (N) when the lid is attached.

11. The hinge assembly of claim 1, wherein the receiver comprises a magnetically responsive disc formed from a ferromagnetic alloy selected from iron, low-carbon steel, or nickel-iron alloy.

12. A method of installing a hinge assembly for a toilet seat and lid, comprising:

securing the mounting bracket of the hinge assembly of claim 1 to the upper rear deck portion of a toilet bowl;

inserting the hinge pin through the mounting bracket bore;

coupling the seat arm to the hinge pin and fastening the seat arm to a toilet seat; and coupling the lid arm to the hinge pin and magnetically attaching a toilet lid to the lid arm.

13. The method of claim 12, wherein magnetically attaching the toilet lid comprises aligning the receiver groove on the underside of the lid with the magnet disposed in the lid arm.

14. The method of claim 12, wherein securing the mounting bracket comprises inserting a mechanical fastener through an aperture in the mounting bracket body and into a preformed hole in the toilet bowl.

15. The method of claim 12, wherein the hinge pin provides a rotational axis about which both the toilet seat and toilet lid independently pivot.

16. The method of claim 12, further comprising removing the toilet lid by applying an upward force sufficient to overcome a magnetic attraction between the magnet and the receiver.

17. The method of claim 12, further comprising replacing the toilet lid with a second toilet lid having a receiver configured to engage the magnet.

18. The method of claim 12, wherein attaching the lid arm comprises inserting the hinge pin into a bore formed in the lid arm and positioning a recessed region of the lid arm adjacent to a seat buffer.

19. The method of claim 12, wherein the magnetic attachment permits tool-free removal and reinstallation of the toilet lid by a user.

20. A method of using a toilet hinge assembly, comprising:

raising and lowering a toilet seat and a toilet lid about a hinge pin supported by a mounting bracket;

selectively detaching the toilet lid from the hinge assembly of claim 1 by lifting the lid to disengage a magnetic connection between the lid arm magnet disposed and the receiver in the lid; and replacing the detached toilet lid with a different toilet lid by lowering the different toilet lid into position such that the magnetic connection is reestablished without the use of tools.

* * * * *